US009434062B2

(12) United States Patent
Kamegai

(10) Patent No.: US 9,434,062 B2
(45) Date of Patent: Sep. 6, 2016

(54) POWER TOOL

(75) Inventor: Hikaru Kamegai, Anjo (JP)

(73) Assignee: MAKITA CORPORATION, Anjo (JP)

( * ) Notice: Subject to any disclaimer, the term of this patent is extended or adjusted under 35 U.S.C. 154(b) by 896 days.

(21) Appl. No.: 13/378,469

(22) PCT Filed: Jun. 16, 2010

(86) PCT No.: PCT/JP2010/060221
§ 371 (c)(1),
(2), (4) Date: Mar. 7, 2012

(87) PCT Pub. No.: WO2010/147153
PCT Pub. Date: Dec. 23, 2010

(65) Prior Publication Data

US 2012/0160533 A1 Jun. 28, 2012

(30) Foreign Application Priority Data

Jun. 19, 2009 (JP) ..... 2009-146311

(51) Int. Cl.
*B25D 17/00* (2006.01)
*B25F 5/00* (2006.01)
(Continued)

(52) U.S. Cl.
CPC ..... *B25F 5/006* (2013.01); *B25D 17/20* (2013.01); *B25D 17/24* (2013.01);
(Continued)

(58) Field of Classification Search
CPC ..... B25F 5/006; B25F 5/02; B25F 5/026; B25F 5/00; B25F 1/00; B25D 17/24; B25D 17/073; B25D 2250/371; B25D 2217/0092; B25D 2250/121; B25D 2222/57; B25D 17/04; B25D 2217/0019; B25D 2250/065
USPC ..... 173/162.1, 210–211, 170
See application file for complete search history.

(56) References Cited

U.S. PATENT DOCUMENTS 2,189,870 A * 2/1940 Sluyter ..... B62J 1/02 16/44
2,819,063 A * 1/1958 Neidhart ..... F16F 1/50 188/129

(Continued)

FOREIGN PATENT DOCUMENTS

CN 101155671 A 4/2008
DE 42 11 316 A1 10/1993

(Continued)

OTHER PUBLICATIONS

International Search Report issued in Application No. PCT/JP2010/060221; Dated Sep. 14, 2010 (With Translation).

(Continued)

*Primary Examiner* — Robert Long
(74) *Attorney, Agent, or Firm* — Oliff PLC

(57) ABSTRACT

A power tool for performing a predetermined operation by using a tool driven by a motor including a first housing to which the tool is attached at an end of the first housing and which has a cylindrical portion of the first housing, a second housing which has a cylindrical portion of the second housing covering the cylindrical portion of the first housing, and a vibration reduction member which is provided between the cylindrical portion of the first housing and the cylindrical portion of the second housing and which reduces transmission of vibration between the first housing and the second housing via elastic shearing deformation of the vibration reduction member. A direction of the shearing deformation of the vibration reduction member corresponds to a direction of a rotation axis of the motor.

11 Claims, 4 Drawing Sheets

(51) Int. Cl.
*B25D 17/24* (2006.01)
*B25D 17/20* (2006.01)

(52) U.S. Cl.
CPC *B25D 2211/061* (2013.01); *B25D 2217/0061* (2013.01); *B25D 2222/57* (2013.01); *B25D 2250/121* (2013.01); *B25D 2250/371* (2013.01)

(56) References Cited

U.S. PATENT DOCUMENTS 3,637,029 A * 1/1972 Sherwood et al. ..... 173/162.2
4,401,167 A * 8/1983 Sekizawa ..... B25D 17/043 173/162.1
4,630,809 A * 12/1986 Duckworth ..... E21B 17/07 267/125
4,749,049 A * 6/1988 Greppmair ..... 173/162.2
4,771,833 A * 9/1988 Honsa ..... B25D 17/043 16/431
4,936,394 A 6/1990 Ohtsu
5,052,500 A * 10/1991 Ohtsu ..... B24B 23/005 16/431
5,453,577 A * 9/1995 Everett ..... B24B 23/005 173/162.2
5,522,466 A * 6/1996 Harada ..... B25F 5/006 173/162.2
5,692,574 A * 12/1997 Terada ..... 173/162.2
5,927,407 A * 7/1999 Gwinn ..... B25D 17/043 173/162.2
6,148,930 A * 11/2000 Berger et al. ..... 173/162.2
6,286,610 B1 * 9/2001 Berger et al. ..... 173/162.1
7,819,203 B2 * 10/2010 Sato et al. ..... 173/210
7,836,971 B2 * 11/2010 Kikuchi ..... B25D 17/043 16/431
7,921,935 B2 * 4/2011 Engelfried et al. ..... 173/162.2
7,967,079 B2 * 6/2011 Stierle et al. ..... 173/216
8,038,133 B2 * 10/2011 McPherson ..... F16L 9/21 173/162.2
8,061,438 B2 * 11/2011 Schmid et al. ..... 173/162.2
8,240,395 B2 * 8/2012 Kamegai et al. ..... 173/162.2
8,590,633 B2 * 11/2013 Berghauser ..... B25D 17/06 173/109
8,966,773 B2 * 3/2015 Gregorich ..... B25F 5/006 173/162.2
9,168,652 B2 * 10/2015 Schadow ..... B25F 5/006
2006/0086515 A1 * 4/2006 Engelfried ..... 173/162.2
2006/0113098 A1 * 6/2006 Inagawa et al. ..... 173/162.2
2006/0289183 A1 * 12/2006 Schreiber ..... 173/162.2
2007/0289762 A1 * 12/2007 Kikukchi et al. ..... 173/162.1
2007/0295521 A1 * 12/2007 Wiker et al. ..... 173/162.1
2008/0202784 A1 8/2008 Stierle et al.
2009/0266571 A1 * 10/2009 Baumann et al. ..... 173/162.2
2009/0294144 A1 * 12/2009 Frauhammer et al. .... 173/162.2
2010/0012339 A1 * 1/2010 Hahn et al. ..... 173/162.2
2010/0186979 A1 * 7/2010 Krauter et al. ..... 173/162.2
2010/0193209 A1 * 8/2010 Schadow et al. ..... 173/162.2
2010/0206596 A1 * 8/2010 Kamegai et al. ..... 173/162.2
2011/0011608 A1 * 1/2011 Saur ..... 173/162.2
2011/0100665 A1 * 5/2011 Nakashima ..... 173/162.2
2012/0031639 A1 * 2/2012 Roberts et al. ..... 173/162.2
2014/0163664 A1 * 6/2014 Goldsmith ..... 623/1.11

FOREIGN PATENT DOCUMENTS

DE 10 2005 016453 A1 10/2006
EP 1 832 395 A1 9/2007
JP A-54-002903 1/1979
JP A-57-100480 12/1982
JP Y2-01-018306 5/1989
JP A-01-281881 11/1989
JP A-02-124283 5/1990
JP A-2-124283 5/1990
JP U-05-005380 1/1993
JP H07-266260 A 10/1995
JP A-2004-106136 4/2004
JP A-2009-090450 4/2009
SU 210043 1/1968

OTHER PUBLICATIONS

Chinese Office Action issued in Application No. 201080027389.9; Dated Oct. 22, 2013.
International Preliminary Report on Patentability issued in Application No. PCT/JP2010/060221; Dated Jan. 17, 2012 (With Translation).
Oct. 9, 2014 Office Action issued in Russian Application No. 2012101788/02(002421).
Oct. 22, 2014 Office Action issued in Chinese Application No. 201080027389.9.
Apr. 16, 2014 Office Action issued in Chinese Application No. 201080027389.9.
May 28, 2014 Office Action issued in Russian Federation Application No. 2012101788 (with English Translation).
Mar. 2, 2015 European Search Report issued in European Application No. 10 78 9527.

* cited by examiner

POWER TOOL

FIELD OF THE INVENTION

The invention relates to a technique to reduce a vibration of a power tool which performs a predetermined operation by using a tool driven by a motor.

BACKGROUND OF THE INVENTION

Japanese Examined Utility Model Application Publication No. H01-018306 discloses a vibration reducing mechanism of an electric hammer. The electric hammer connects a handle to a body via an elastic rubber to reduce transmission of vibration occurred on the body to the handle, when the electric hammer is driven.

However, further improvement for a vibration reducing mechanism is desired.

SUMMARY OF THE INVENTION

Problem to be Solved by the Invention

An object of the invention is, in consideration of the above described problem, to provide a technique which further improves a vibration reducing effect of a power tool.

Means for Solving the Problem

Above-mentioned object is achieved by the claimed invention. According to a preferred embodiment of the invention, a representative power tool is provided to perform a predetermined operation by using a tool driven by a motor. The power tool including: a first housing to which the tool is attached at an end of the first housing and which has a first cylindrical portion at the other end; a second housing which has a second cylindrical portion covering the first cylindrical portion, wherein the second cylindrical portion is adapted relatively movable to the first cylindrical portion; and a vibration reduction member which is provided between the first cylindrical portion and the second cylindrical portion and which reduces transmission of vibration between the first housing and the second housing via elastic shearing deformation of the vibration reduction member. Then, a direction of the shearing deformation of the vibration reduction member corresponds to a direction of a rotation axis of the motor. Further, typically the motor is preferable entirely or partially housed in the first housing.

The power tool of the invention preferably includes that typically not only a hammer tool, such as a hammer which performs a hammer operation to a workpiece by making a hammer bit as a tool a hammering action along a longitudinal direction of the hammer bit or a hammer drill which performs a hammer-drill operation to a workpiece by making a hammer bit a hammering action and a drill action or like this, but also, aside from the hammer tool, a disk grinder or a disk sander which performs a grind operation to a workpiece by making a grinding wheel or a sanding wheel as a tool a grind action. Further, the first housing of the invention typically corresponds to a housing which houses a motor, a driving mechanism which drives the tool by transmitting rotation force of the motor and so on, and the second housing of the invention corresponds to a handle which is held by a user to operate the power tool. The vibration reduction member of the invention typically corresponds to a rubber.

According to the invention described above, when the power tool is in an operation, transmission of vibration between the first housing and the second housing via a damping effect of a shearing deformation of the vibration reduction member is reduced. A shearing stiffness of the vibration reduction member is lower than an axial stiffness. That is, according to the invention, by utilizing a feature which an effect of reducing vibration via the shearing deformation is higher than an effect of reducing vibration via the axial deformation, according to the power tool having the second cylindrical portion which covers the first cylindrical portion, the power tool is arranged and adapted to reduce transmission of vibration between the first housing and the second housing via the damping effect of the shearing deformation, in this way, an effect of reducing vibration is further improved.

According to a further preferable aspect of the invention, a cooling air passage is formed by means of a gap between the first cylindrical portion and the second cylindrical portion, wherein the vibration reduction member is located at the cooling air passage and cooled by an air flowing through the cooling air passage, which flowed by means of a cooling motor fan to cool the motor, wherein the cooling motor fan is housed in the first housing together with the motor.

A rubber as a vibration reduction member has both effects of reducing vibration by means of spring action and damping action. In damping action, vibration is changed into heat so that the rubber itself adversely generates heat. According to the invention, when the rubber is utilized as the vibration reduction member, because the vibration reduction member is located at the cooling air passage and is cooled by means of a cooling air forcibly flowed by the cooling motor fan, thermal degradation is reduced and endurance of the vibration reduction member is improved. Especially, according to the invention, because the first cylindrical portion is covered by the second cylindrical portion, the gap of both of housings is rationally useful as the cooling air passage.

According to a further preferable aspect of the invention, the second housing has a grip portion held by a user of the power tool, wherein the grip portion extends in a direction crossing a longitudinal direction of the second housing from one end of the second cylindrical portion opposite to the end where the tool is attached and wherein a distal end of the grip portion is defined as a free end. Further, the cooling motor fan is provided closer to the tool than the motor, and the vibration reduction member is provided between the motor and the cooling motor fan.

The grip portion is also called a pistol-formed grip, which the grip portion extends in a direction crossing a longitudinal direction of the second housing from the one end of the second cylindrical portion and the distal end of the grip portion is defined as a free end. In the power tool having the grip portion shaped like described above, when the power tool performs an operation to a workpiece, aside from gripping the grip portion by a hand and fingers, there is other way of gripping the grip portion by putting a palm on an end (rear end) which is in vicinity of a connection area of the cylindrical portion and the grip portion, and putting fingers on side surface of the cylindrical portion, in the latter way of gripping, tip of the fingers extend forward along the side surface of the cylindrical portion, that is, the tip of fingers extend toward a side of the tool attached. On the other hand, when the vibration reduction member is provided between the first cylindrical portion and the second cylindrical portion, a part of the second housing corresponding to where the vibration reduction member is provided, may protrude toward outside, when a protruding part exists, because the tip of fingers may touch the protruding part by means of the latter way of gripping the grip portion, easiness of gripping performance may be harmed.

According to the invention, the vibration reduction member is provided between the motor and the cooling motor fan described above, that is, the vibration reduction member is provided more forward than the motor. In order to compose like this, a length between an end of the grip portion opposed to the tool and the protruding part is set to at least a length corresponding to a length of a motor shaft. Accordingly, harming easiness of gripping grip by means of the latter way of gripping the grip portion is avoided.

According to a further preferable aspect of the invention, the power tool further comprising; an air inlet which leads an air from outside to the cooling air passage, and an air outlet which exhausts the air to outside wherein the motor is cooled by the air, wherein the air outlet is provided closer to the tool than the air inlet. Furthermore, the air outlet of the aspect is typically defined by a singular slit or plurality of slits which extends for a predetermined length along a circumference direction or a longitudinal direction of a housing, and provided at the first housing. Further, the air inlet of the invention is typically provided at a front side of the second cylindrical portion which covers the first housing.

When the power tool performs an operation to a workpiece, if dust occurred by the operation to a workpiece flies toward a side of the grip portion from a side of the tool, the dust may be carried into the cooling air passage by the air led from the air inlet. According to the invention, when viewed from the tool attached side, the air inlet is located backward with respect to the air outlet so that a protection wall (air barrier) is formed by flowing air exhausted from the air outlet, in this way, the dust and things like that are prevented from entering into the air inlet and the motor and so on provided in the housing are protected against the dust. Furthermore, a distance between the air outlet and the air inlet may be decided accordingly to get an effect of dust protection with respect to the air inlet by taking into consideration about amount of the air, strength (velocity) of the air and so on exhausted from the air outlet.

According to a further preferable aspect of the power tool of the invention, the air outlet and the air inlet are arranged in conformity with each other with respect to a circumference direction of the first housing. Further, the air outlet and the air inlet may be arranged at a region where an air flow exhausted from the air outlet hardly gives bad effect to a user holding the power tool, that is, if the power tool is adapted for a right-hander, the region corresponds to a right side surface or an under surface of the first housing or the second housing.

According to a further preferable aspect of the power tool of the invention, the air inlet has a dust prevention portion to prevent dust from entering into the air inlet. Further, the dust prevention portion is preferably adapted by a labyrinth seal or an air filter and so on. According to the invention, dust is prevented from entering from the air inlet and the motor and so on provided in the housing are protected against the dust.

According to the invention, a technique which further improves a vibration reducing effect of a power tool is provided. Other objects, features and advantages of the present invention will be readily understood after reading the following detailed description together with the accompanying drawings and the claims.

DESCRIPTION OF THE PREFERRED EMBODIMENTS

Each of the additional features and method steps disclosed above and below may be utilized separately or in conjunction with other features and method steps to provide and manufacture improved a power tool and method for using such the power tool and devices utilized therein. Representative examples of the present invention, which examples utilized many of these additional features and method steps in conjunction, will now be described in detail with reference to the drawings. This detailed description is merely intended to teach a person skilled in the art further details for practicing preferred aspects of the present teachings and is not intended to limit the scope of the invention. Only the claims define the scope of the claimed invention. Therefore, combinations of features and steps disclosed within the following detailed description may not be necessary to practice the invention in the broadest sense, and are instead taught merely to particularly describe some representative examples of the invention, which detailed description will now be given with reference to the accompanying drawings.

Figure 1:
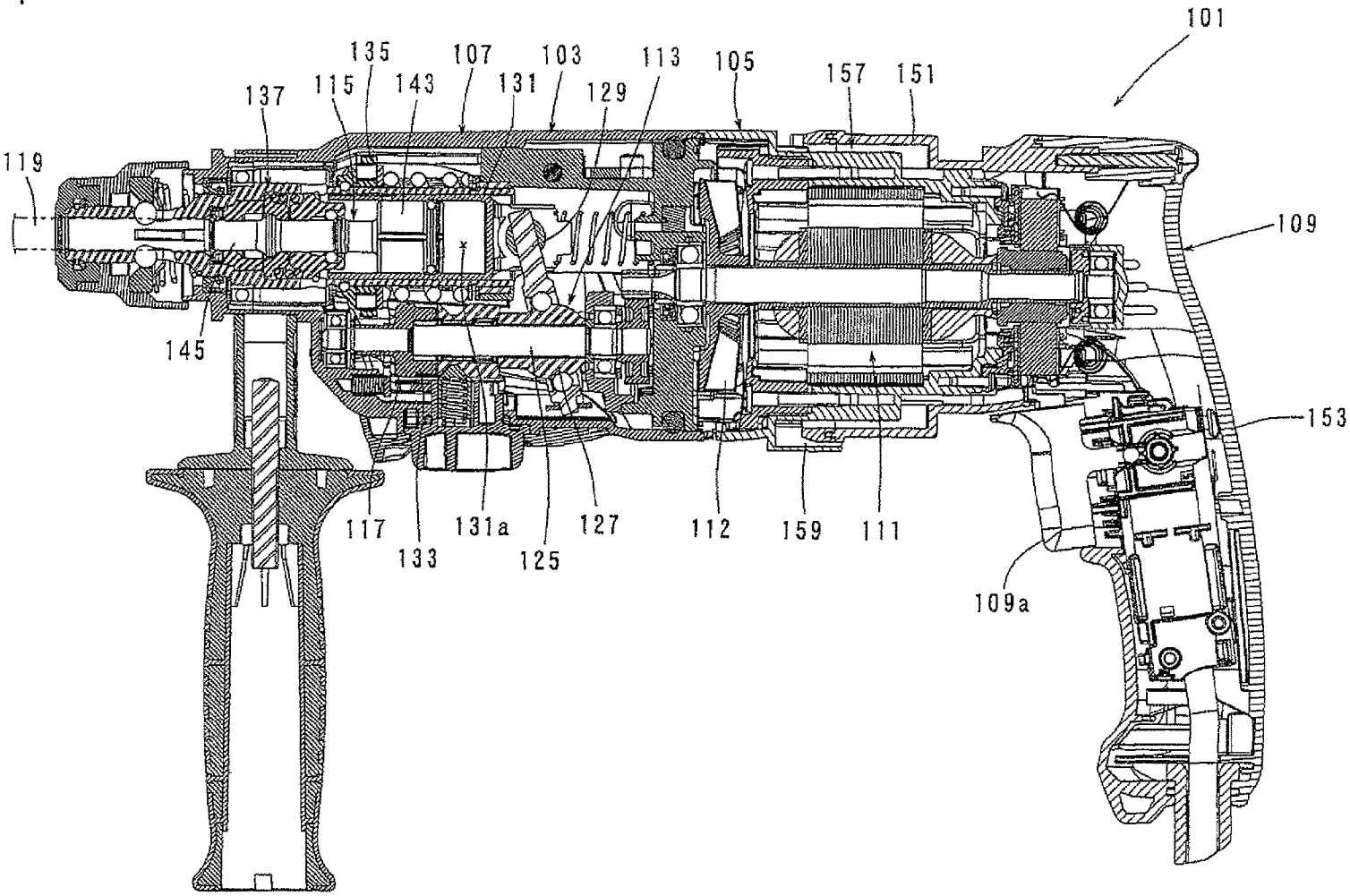
FIG. 1 shows a cross-sectional view of a total composition of a hammer drill in accordance with an embodiment of the invention.

Next, an embodiment of the invention will be explained with reference to FIG. 1 to FIG. 5. In this embodiment, the invention will be explained by applying to an electric hammer drill as one example of a power tool. As shown in FIG. 1, generally to say, a hammer drill 101 of this embodiment is provided mainly with a body 103 which forms an outer shell of the power tool 101, a hammer bit 119 which is detachably attached to a front side (a left side of FIG. 1) of the body 103 via a tool holder 137, and a handle 109 which connects to the body 103 opposed to the hammer bit 119. The body 103 corresponds to a first housing according to the invention. The handle 109 corresponds to a second housing of the invention. The hammer bit 119 corresponds to a tool according to the invention.

The body 103 is provided mainly with a motor housing 105 which houses a driving motor 111, and a gear housing 107 which houses a motion conversion mechanism 113, a hammering element 115 and a power transmission mechanism 117. The driving motor 111 corresponds to a motor according to the invention. The motion conversion mechanism 113, the hammering element 115 and the power transmission mechanism 117 define a driving mechanism according to the invention. The driving motor 111 is provided as a rotational axis of the driving motor 111 is arranged in parallel with a longitudinal direction of the body 103 (a longitudinal direction of the hammer bit 119). That is, a direction of the rotational axis of the driving motor 111 is arranged in conformity with a direction of the hammer bit 119 to hammer. A rotation output of the driving motor 111 is converted as needed to a linear motion by the motion conversion mechanism 113, and then transmitted to the hammering element 115, therefore the rotation output makes an impact force via the hammering element 115 along the longitudinal direction (a lateral direction in FIG. 1) of the hammer bit 119. The rotation output of the driving motor 111 is decelerated as needed by the motion transmission mechanism 117, and then transmitted to the hammer bit 119, therefore the hammer bit 119 rotates in a circumference direction. The driving motor 111 is turned on and driven by pulling a trigger 109*a* which is provided on the handle 109. For convenience to explain, a side where the hammer bit 119 is provided is called front and the other side where the handle 109 is provided is called rear.

The motion conversion mechanism 113 is provide mainly with an intermediate shaft 125 which is rotated by the driving motor 111, a swinging ring 129 which is defined as a swinging member swung along the longitudinal direction of the hammer bit 119 accompanied by a rotation of the intermediate shaft 125 via a rotating member 127, and a cylindrical piston 131 which moves linearly along the longitudinal direction of the hammer bit 119 with a swing of the swing ring 129. On the other hand, the power transmission mechanism 117 is provided mainly with a decelerating gear mechanism which is defined by a plurality of gears such as a small diameter gear 133 which rotates at unity with the intermediate shaft 125, and a large diameter gear 135 which engages with the small diameter gear 133, and so on. Therefore the power transmission mechanism 117 transmits torque to the tool holder 137. In this way, the tool holder 137 rotates in a vertical plane, with accompanying a rotation of the tool holder 137, the hammer bit 119 rotates which is held by the tool holder 137. Concerning compositions of the power conversion mechanism 113 and the power transmission mechanism 117, the compositions are well known, therefore a detail description of those compositions is omitted.

The hammering element 115 is provided mainly with a striker 143 as a hammer element which is slidably arranged in a cylindrical piston 131, and an impact bolt 145 as an intermediate element which is slidably arranged against the tool holder 137. The striker 143 is moved via an air spring (pressure fluctuation) of an air space 131*a* accompanied with a sliding motion of the cylindrical piston 131, and the striker 143 impacts (hammers) the impact bolt 145, therefore an impact force is transmitted to the hammer bit 119 via the impact bolt 145.

In the hammer drill 101 described above, when the driving motor 111 is turned on, after the rotation output is converted to the linear motion via the motion conversion mechanism 113, the rotation output is transmitted as the linear motion to the hammer bit 119 in the longitudinal direction of the hammer bit 119 via the hammering element 115. That is, the hammer bit 119 performs a hammering action. In addition to the hammering action described above, the rotation is transmitted to the hammer bit 119 via the motion transmission mechanism 117 driven by the rotation output of the driving motor 111, therefore the hammer bit 119 performs a rotation action in a circumference direction. That is, the hammer bit 119 acts the hammering action along the longitudinal direction and the rotation action in the circumference direction, therefore the hammer bit 119 performs a hammer-drill operation to a workpiece.

Further, it is not drawn in drawings for convenience, but the hammer drill 101 has a dial to change modes of operation to perform. By a user operates the dial as needed, the modes may be changed between a drill mode which the hammer drill 101 performs a drill operation to the workpiece by giving the hammer bit 119 the impact force in the longitudinal direction and the rotation in the circumference direction, and a hammer-drill mode which the hammer drill 101 performs the hammer-drill operation to the workpiece by giving the hammer bit 119 only the rotation in the circumference direction. Because a mode changing mechanism mentioned above is well known and is not directly concerned with the invitation, a detail description of the mode changing mechanism is omitted.

When the power tool is in an operation described above, impactive and cyclic vibration along the longitudinal direction of the hammer bit 119 is occurred on the body 103. Next, a vibration reducing mechanism to reduce transmission of the vibration occurred on the body 103 to the handle 109 held by a user, will be explained.

Figure 2:
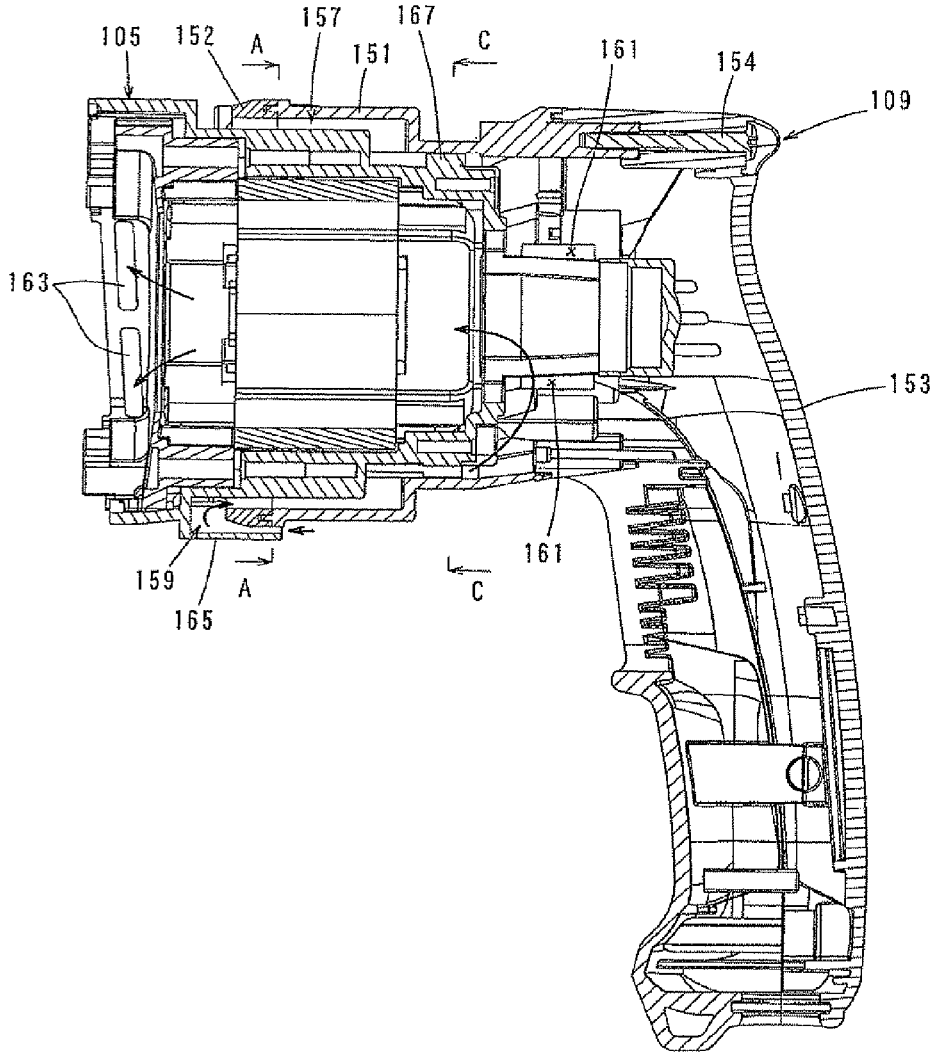
FIG. 2 shows a cross-sectional view of a vibration reducing handle.

As shown in FIG. 2, the handle 109 has a cylindrical housing portion 151 formed approximately as a cylinder which has an opening toward the front, and a grip portion 153 held by a user which is fixed to a rear end of the cylindrical housing portion 151 via a plurality of screws. The cylindrical housing portion 151 of the grip 109 covers over almost all regions except a region of a front part within the motor housing 105 formed approximately as a cylinder. The cylindrical housing portion 151 corresponds to a second cylindrical portion according to the invention, and the motor housing 105 corresponds to a first cylindrical portion according to the invention.

The motor housing 105 is formed as a cylindrical member which extends in parallel with the longitudinal direction of the hammer bit 119, and houses the driving motor 111 and a cooling motor fan 112 which is driven by the driving motor 111 (refer to FIG. 1). The cooling motor fan 112 is arranged forward against the driving motor 111. For convenience, the cooling motor fan 112 is omitted to draw in FIG. 2. The grip portion 153 of the handle 109 is formed as a rod-shaped member which extends in a direction (down ward) crossing a longitudinal direction of the cylindrical housing portion 151 (the longitudinal direction of the hammer bit 119) from a rear end of the cylindrical housing portion 151 and a distal end of the grip portion 153 is defined as a free end. The handle 109 having the grip portion 153 described above is called generally a pistol-shaped handle.

Figure 3:
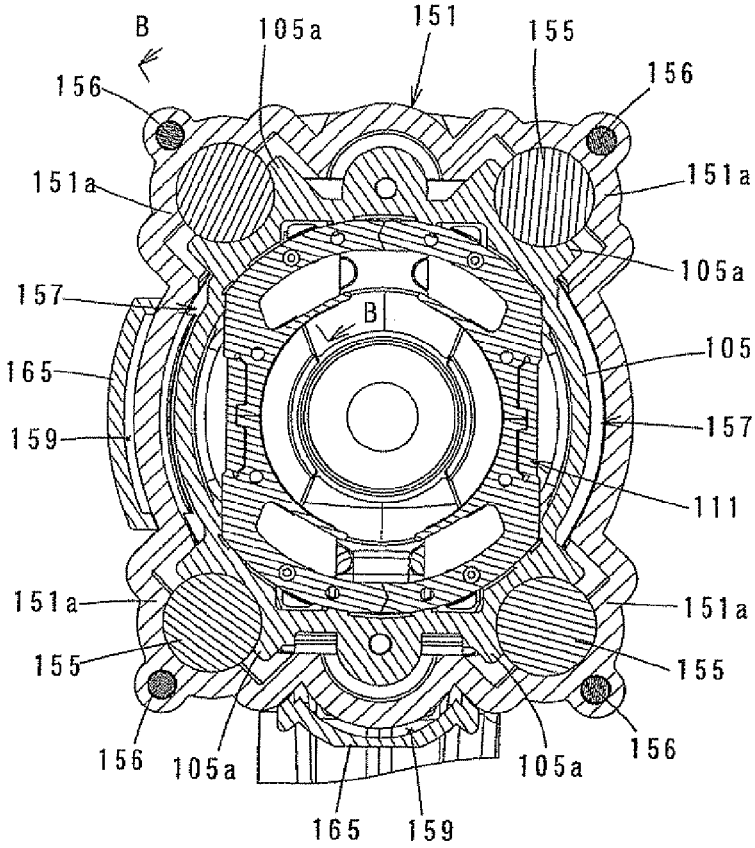
FIG. 3 shows a cross-sectional view taken from line A-A of FIG. 2.

As shown in FIG. 3, a plurality of elastic rubbers 155, in this embodiment, four elastic rubbers 155 to reduce vibration are arranged between an outside surface of the motor housing 105 and an inside surface of the cylindrical housing portion 151 of the handle 109 which covers the motor housing 105, and each of the four elastic rubbers 155 is arranged at certain interval around the rotational axis of the driving motor 111 (along a circumference direction of the cylindrical housing portion 151). That is, the cylindrical housing portion 151 is relatively movable to the motor housing 105 and connects the motor housing 105 via the four elastic rubbers 155 arranged around the rotational axis of the driving motor 111. The elastic rubber 155 corresponds to a vibration reduction member according to the invention.

Figure 4:
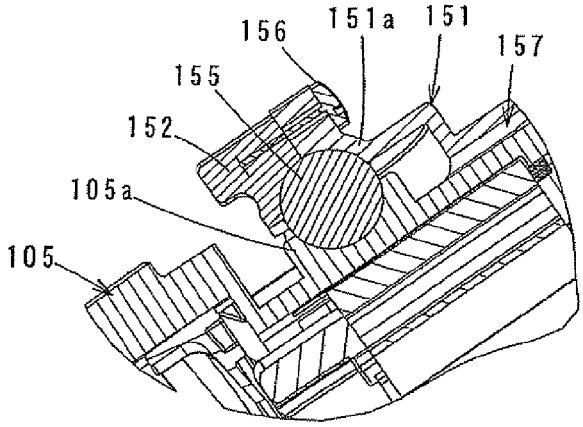
FIG. 4 shows a cross-sectional view taken from line B-B of FIG. 3.

The four elastic rubbers 155 are arranged symmetry with respect to a vertical line crossing the rotational axis of the driving motor 111. Each of the elastic rubbers 155 is clamped by an outside rubber receiving portion 151*a* which has a semispherical depressed surface formed on the cylindrical housing portion 151, and an inside rubber receiving portion 105*a* which has a semispherical depressed surface formed on the motor housing 105. Further, as shown in FIG. 4, the outside rubber receiving portion 151*a* of the cylindrical housing portion 151 consists of the cylindrical housing portion 151 and the a ring-shaped cover 152 fixed in front of the cylindrical housing portion 151 via a plurality of screws 156. In other words, by dividing a front side of the cylindrical housing portion 151 into a housing portion and a cover portion, the outside rubber receiving portion 151*a* is formed across both of divided the housing portion and the cover portion. Therefore, the elastic rubber 155 is assembled between the motor housing 105 and the cylindrical housing portion 151.

In a connecting mechanism which connects the cylindrical housing portion 151 and the motor housing 105 via the four elastic rubbers 155, concerning a right part and a left part arranged upper side with respect to a horizontal line crossing the rotational axis of the driving motor 111, facing surfaces of the outside rubber receiving portion 151*a* and the inside rubber receiving portion 105*a* facing each other in each parts forms approximately inversed V-formation when viewed from a side of the handle 109 (a rear side). On the other hand, concerning a right part and a left part arranged lower side, facing surfaces of the outside rubber receiving portion 151*a* and the inside rubber receiving portion 105*a* facing each other in each parts forms approximately V-formation when viewed from the side of the handle 109. That is, the facing surfaces of the outside rubber receiving portion 151*a* and the inside rubber receiving portion 105*a* are arranged in parallel with the longitudinal direction of the hammer bit 119 and inclined at an angle of approximately 45 degrees with respect to horizontal direction (a direction of right and left) and vertical direction (a direction of top and bottom) crossing the longitudinal direction respectively. In this way, shearing force acts on each of the elastic rubbers 155 mainly in the longitudinal direction and axial compression force acts on each of the elastic rubbers 155 mainly in a direction crossing the longitudinal direction.

As described above, the ring-shaped gap is formed between the inside surface of the cylindrical housing portion 151 (including an inside surface of the cover 152) and the outside surface of the motor housing 105 connected each other via the elastic rubber 155, and the elastic rubber 155 is provide at the gap. In this embodiment, the gap forms a cooling air passage 157 to cool the driving motor 111, and further the driving motor 111 and the elastic rubber 155 are cooled by an air flowing through the cooling air passage 157 flowed forcibly by means of the cooling motor fan 112. The motor housing 105 has an air inlet 159 which leads an air from outside into a front side of the cooling air passage 157.

Accordingly, when the cooling motor fan 112 is driven by driving of the driving motor 111, an outside air is led from the air inlet 159 into the cooling air passage 157. After the air which is led into the cooling air passage 157 flows rearward through the cooling air passage 157, the air flows into a rear side of the motor housing 105 via an opening 161 provided at the rear side of the motor housing 105 (nearby a power supplying portion of the driving motor 111). After the air which is flowed into the motor housing 105 flows forward and cools the driving motor 111, the air is exhausted to outside from an air outlet 163 provided at a front side of the motor housing 105. An air flow is shown by arrowed lines in FIG. 2.

As shown in FIG. 2, the air outlet 163 is provided more forward than the air inlet 159, and the air outlet 163 is arranged at right side and underside surface totally two points of the motor housing 105, when viewed from the side of the handle (for convenience, only the air inlet 163 arranged at right side is shown). In this embodiment, the hammer drill 101 is intended to a right-handed user who grips the grip portion 153 of the handle 109 by right hand of the user, therefore a location of the air outlet 163 is defined at where the air which is exhausted from the air outlet 153 does not give a bad effect to the user. The air outlet 153 is composed of a slit (pore) which extends in the circumference direction of the motor housing 105.

Further, the air inlet 159 is arranged at right side and underside surface totally two points of the motor housing 105 corresponding to the air outlet 163. That is, the air inlet 159 is provided in conformity with the air outlet 163 with respect to the circumference direction of the motor housing 105. As shown in FIG. 2 and FIG. 3, the motor housing 105 has cover portions 165 at right side and underside surface of the motor housing 105, which protrude toward rear side from where the motor housing 105 is not covered by the cylindrical housing portion 151 respectively. The cover portion 165 extends toward the rear side along an outside surface of the cylindrical housing portion 151, therefore the air inlet 159 is formed between an inside surface of the cover portion 165 and the outside surface of the cylindrical housing portion 151, and the air inlet 159 is only opened toward the rear side. That is, the air inlet 159 of the invention, is defined as an inner space through which the outside air flows, after the outside air inflows from an opening of the rear side of the cover portion 165, the outside air changes the direction of flowing at the inner part (the front side) of the cover portion 165 and flows into the cooling air passage 157. In this way, the air inlet 159 has a labyrinth seal composed of a passage formed U-formation. Therefore, it is hard to allow dust to enter from the air inlet 159. Further, concerning a region other than where the air inlet 159 is defined among an opening region of the front side of the cooling air passage 157, for example, the region is formed as a tightened passage arranged between the outside surface of the cylindrical housing portion 151 and the inside surface of the motor housing 105, or the region has a seal portion on the cover 152 which seals a gap, therefore dust is hardly allowed to enter from the air inlet 159.

Figure 5:
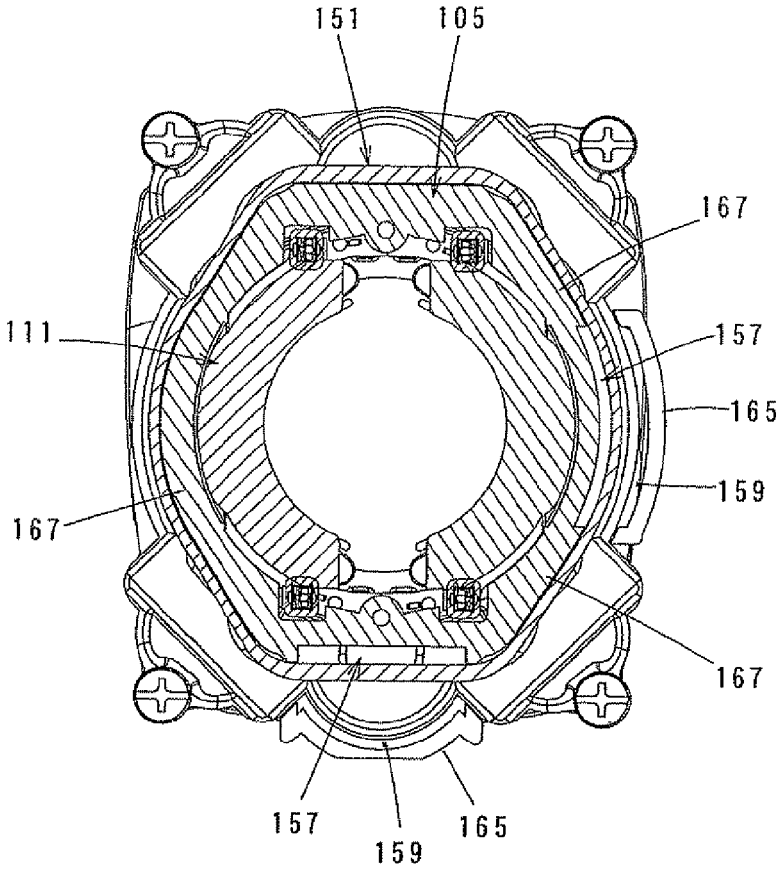
FIG. 5 shows a cross-sectional view taken from line C-C of FIG. 2.

As shown in FIG. 5, further, when viewed from a side of the handle 109 (a rear side), in a region other than a right side region and an underside region within a region provided the cooling air passage 157 formed as ring-shaped between the inside surface of the cylindrical housing portion 151 and the outside of the motor housing 105, a slide guide 167 which guides the cylindrical housing portion 167 is provided. The slide guide 167 is provided together with the motor housing 105 in some region with respect to the longitudinal direction of the motor housing 105, an outside surface of the slide guide 167 slidably contacts to the inside surface of the cylindrical housing portion 151, therefore the cylindrical housing portion 151 is relatively movable in the longitudinal direction steadily with respect to the motor housing 105.

The hammer drill 101 of the invention is comprised described above. Accordingly, when the hammer drill 101 is in an operation, impactive and cyclic vibration along the longitudinal direction of the hammer bit 119 is occurred on the body 103, but transmission of the vibration from the motor housing 105 which is a component of the body 103 to the cylindrical housing portion 151 which is a component of the handle 109 is restricted by means of an elastic deformation of the elastic rubber 155. In this invention, the spherical elastic rubber 155 is held by fitting in a spherical depressed surface of the inside rubber receiving portion 105*a* and a spherical depressed surface of the outside rubber receiving portion 151*a*. In this way, the elastic rubber 155 deforms in shearing direction due to the vibration described above. That is, in this invention, it is utilized a feature of the elastic rubber 155 that a vibration reducing effect of the vibration by means of a shearing deformation of the elastic rubber 155 is more effective than a vibration reducing effect of the vibration by means of a axial deformation, therefore the vibration reducing effect of the handle 109 by means of the shearing deformation of the elastic rubber 155 is improved.

On the other hand, the cylindrical housing portion 151 of the handle 109 is guided in the longitudinal direction of the hammer bit 119 by the slide guide 167 provided on the motor housing 105. Therefore, when added a pushing power in the longitudinal direction onto the body 103 of the hammer drill 101 to perform a operation, a pushing operation against the workpiece is performed under stable condition.

Further, in this embodiment, a vibration reducing handle is provided by arranging the cylindrical housing portion 151 of the handle 109 on which the cylindrical housing portion 151 covers the motor housing 105 via the elastic rubber 155, and the gap between the motor housing 105 and the cylindrical housing portion 151 is defined as the cooling air passage 157 through which an air flows forcibly by means of the cooling motor fan 112, therefore the elastic rubber 155 is actively cooled. When the elastic rubber 155 reduces the vibration by means of its damping effect, the vibration is changed into heat so that the elastic rubber 155 itself adversely generates heat, but according to this embodiment, the elastic rubber 155 located at the cooling air passage 157 is cooled by the air flowing through the cooling air passage 157, therefore it is possible thermal degradation of the elastic rubber 155 is reduced and endurance of the elastic rubber 155 is improved.

Further, according to this embodiment, the gap between the motor housing 105 and cylindrical housing portion 151 is defined as the cooling air passage 157 of flowing air, so that a ready-made air inlet may be eliminated or reduced, and greater design flexibility is offered.

Further, in case the elastic rubber 155 is provided between the motor housing 105 and the cylindrical housing portion 151 covering the motor housing 105, as shown in FIG. 3 and FIG. 4, concerning the cylindrical housing portion 151 located outside, a part of the cylindrical housing portion 151 which receiving the elastic rubber 155, that is the outside rubber receiving portion 151*a*, inevitably protrudes toward outside. In this embodiment, the elastic rubber 155 is provided in vicinity of a front of the driving motor 111. Whatever the hammer drill 101 is small, a longitudinal length of the driving motor 111 which is arranged and adapted to the hammer drill 101 is longer than a finger. Therefore, for example, even if the user grips the handle 109 by putting palm an end where the end is in vicinity of a connection area between the cylindrical housing portion 151 and the grip portion 153, and putting fingers on side surface of the cylindrical housing portion 151, tip of the fingers do not reach to a protruding portion. That is, in this embodiment, even if the protruding portion is formed on the cylindrical housing portion 151 due to a position of the elastic rubber 155, easiness of gripping performance is not harmed.

Further, in this embodiment, the elastic rubber 155 is explained as a sphere, but instead of a sphere it may be formed as a cylinder. Further, the elastic rubber 155 may be provided at two parts with respect to the longitudinal direction of the cylindrical housing portion 151. Further, the cylindrical housing portion 151 may be provided to contact both of the motor housing 105 and the gear housing 107, in this case, it is preferred that the cylindrical housing portion 151 connects respectively the motor housing 105 and the gear housing 107 via the elastic rubber 155. Further, concerning a dust protection mechanism to prevent dust from entering into the air inlet 159, a breathable air filter may be utilized instead of the labyrinth seal.

Further, in the embodiment described above, though the hammer drill is explained as one example of a power tool, a power tool may be adapted to a hammer which only performs the hammering action along the longitudinal direction of the hammer bit 119, or a power tool may be adapted to a grind tool which performs a grinding action to a workpiece. In case that the power tool may be adapted to the grind tool, a handle is not formed as a pistol-shaped handle but approximately a cylinder-shaped housing directly gripped by hand and finger, or a handle extends rearward of the driving motor.

Having regard to an aspect of the invention, following features are provided:

(Feature 1)

The power tool according to claim 1, wherein a plurality of the vibration reduction members located at the cooling air passage is provided with respect to a circumference direction of the second housing.

(Feature 2)

The power tool according to feature 1, wherein the vibration reduction members are provided symmetry with respect to a vertical line crossing a longitudinal direction of the second housing.

(Feature 3)

The power tool according to claim 1, wherein the tool is defined as a hammer bit which performs a hammer action at least along a longitudinal direction against a workpiece, wherein the first housing has a slide guide which guides the second housing slidably in the longitudinal direction of the hammer bit.

DESCRIPTION OF NUMERALS

101 hammer drill (power tool)
103 body (first housing)
105 motor housing (first cylindrical portion)
105*a* inside rubber receiving portion
107 gear housing
109 handle (second housing)
109*a* trigger
111 driving motor (motor)
112 cooling motor fan
113 power conversion mechanism (driving mechanism)
115 hammering element (driving mechanism)
117 power transmission mechanism (driving mechanism)
119 hammer bit (tool)
125 intermediate shaft
127 rotating member
129 swing ring
131 cylindrical piston
133 small diameter gear
135 large diameter gear
137 tool holder
143 striker
145 impact bolt
151 cylindrical housing portion (second cylindrical portion)
151*a* outside rubber receiving portion
152 cover
153 grip portion
154 screw
155 elastic rubber (vibration reduction member)
156 screw
157 cooling air passage
159 air inlet

161 opening
163 air outlet
165 cover portion
167 slide guide

The invention claimed is:

1. A power tool comprising:

a motor configured to rotate an output member about a rotation axis and linearly drive a tool in a direction of a longitudinal axis of the tool to perform a hammering operation, the rotation axis extending in the direction of the longitudinal axis of the tool;

a first housing to which the tool is attached at a first end of the first housing and which has a first cylindrical portion at a second end, the first cylindrical portion having a longitudinal axis extending in the direction of the rotation axis;

a second cylindrical portion covering the first cylindrical portion and a grip portion extending from the second cylindrical portion in a direction crossing the direction of the longitudinal axis of the tool, the second cylindrical portion being movable relative to the first cylindrical portion, the first housing comprising a slide guide that guides the second housing to be slid in contact with the slide guide in the direction of the longitudinal axis of the tool; and a vibration reduction member which is provided between the first cylindrical portion and the second cylindrical portion such that the vibration reduction member reduces the transmission of vibration between the first housing and the second housing via elastic shearing deformation of the vibration reduction member to a greater effect than by axial deformation of the vibration reduction member, wherein a direction of the shearing deformation of the vibration reduction member corresponds to the direction of the rotation axis, and wherein the motor is entirely or partially housed in the first housing wherein a cooling air passage is formed by means of a gap between the first cylindrical portion and the second cylindrical portion, wherein the vibration reduction member is located at the cooling air passage and cooled by an air flowing through the cooling air passage, which flowed by means of a cooling motor fan to cool the motor, wherein the cooling motor fan is housed in the first housing together with the motor, and wherein the second housing has a grip portion held by a user of the power tool, wherein the grip portion extends in a direction crossing a longitudinal direction of the second housing from one end of the second cylindrical portion opposite to the first end where the tool is attached and wherein a distal end of the grip portion is defined as a free end, wherein the cooling motor fan is provided closer to the tool than the motor, wherein the vibration reduction member is provided between the motor and the cooling motor fan.

2. The power tool according to claim 1, wherein a cooling air passage is formed by means of a gap between the first cylindrical portion and the second cylindrical portion, wherein the vibration reduction member is located at the cooling air passage and cooled by an air flowing through the cooling air passage, which flowed by means of a cooling motor fan to cool the motor, wherein the cooling motor fan is housed in the first housing together with the motor.

3. The power tool according to claim 1, wherein the second housing has a grip portion held by a user of the power tool, wherein the grip portion extends in a direction crossing a longitudinal direction of the second housing from one end of the second cylindrical portion opposite to the first end where the tool is attached and wherein a distal end of the grip portion is defined as a free end, wherein the cooling motor fan is provided closer to the tool than the motor, wherein the vibration reduction member is provided between the motor and the cooling motor fan.

4. The power tool according to claim 2, further comprising:

an air inlet which leads an air from outside to the cooling air passage; and an air outlet which exhausts the air to outside wherein the motor is cooled by the air, wherein the air outlet is provided closer to the tool than the air inlet.

5. The power tool according to claim 4, wherein the air outlet and the air inlet are arranged in conformity with each other with respect to a circumference direction of the first housing.

6. The power tool according to claim 4, wherein the air inlet has a dust prevention portion to prevent dust from entering into the air inlet.

7. A power tool comprising:

a motor which drives a tool to perform a predetermined operation;

a first housing to which the tool is attached at a first end of the first housing and which has a first cylindrical portion at a second end;

a second housing which has a second cylindrical portion covering the first cylindrical portion, the second cylindrical portion being relatively movable to the first cylindrical portion; and a vibration reduction member which is provided between the first cylindrical portion and the second cylindrical portion and which reduces the transmission of vibration between the first housing and the second housing via elastic shearing deformation of the vibration reduction member, wherein a direction of the shearing deformation of the vibration reduction member corresponds to a direction of a rotation axis of the motor, the motor is entirely or partially housed in the first housing, a cooling air passage is formed by means of a gap between the first cylindrical portion and the second cylindrical portion, the vibration reduction member is located at the gap between the first cylindrical portion and the second cylindrical portion and cooled by an air flowing from an air inlet through the gap to a cooling motor fan, the air flowing by means of the cooling motor fan to cool the motor, and the cooling motor fan is housed in the first housing together with the motor.

8. The power tool according to claim 7, wherein the second housing has a grip portion held by a user of the power tool, wherein the grip portion extends in a direction crossing a longitudinal direction of the second housing from one end of the second cylindrical portion opposite to the first end where the tool is attached and wherein a distal end of the grip portion is defined as a free end, wherein the cooling motor fan is provided closer to the tool than the motor, wherein the vibration reduction member is provided between the motor and the cooling motor fan.

9. The power tool according to claim 7, further comprising:

the air inlet which leads an air from outside to the cooling air passage; and an air outlet which exhausts the air to outside wherein the motor is cooled by the air, wherein the air outlet is provided closer to the tool than the air inlet.

10. The power tool according to claim 9, wherein the air outlet and the air inlet are arranged in conformity with each other with respect to a circumference direction of the first housing.

11. The power tool according to claim 9, wherein the air inlet has a dust prevention portion to prevent dust from entering into the air inlet.

* * * * *